US011839267B2

(12) United States Patent
Lee

(10) Patent No.: US 11,839,267 B2
(45) Date of Patent: Dec. 12, 2023

(54) APPARATUS FOR GENERATING INFORMATION ON INSIDE OF SHOE AND METHOD USING SAME

(71) Applicant: Hong Kyoo Lee, Seoul (KR)

(72) Inventor: Hong Kyoo Lee, Seoul (KR)

( * ) Notice: Subject to any disclaimer, the term of this patent is extended or adjusted under 35 U.S.C. 154(b) by 726 days.

(21) Appl. No.: 16/978,678

(22) PCT Filed: Aug. 1, 2018

(86) PCT No.: PCT/KR2018/008757

§ 371 (c)(1),
(2) Date: Sep. 5, 2020

(87) PCT Pub. No.: WO2019/172492

PCT Pub. Date: Sep. 12, 2019

(65) Prior Publication Data

US 2020/0397096 A1 Dec. 24, 2020

(30) Foreign Application Priority Data

Mar. 6, 2018 (KR) ..... 10-2018-0026324

(51) Int. Cl.
*A43D 1/08* (2006.01)
*A43D 1/06* (2006.01)

(52) U.S. Cl.
CPC ..... *A43D 1/08* (2013.01); *A43D 1/06* (2013.01)

(58) Field of Classification Search
CPC ..... A43D 1/06; A43D 1/08
USPC ..... 33/3 R, 3 A, 3 B, 3 C, 6
See application file for complete search history.

(56) References Cited

U.S. PATENT DOCUMENTS 4,876,758 A * 10/1989 Rolloff ..... A43B 7/28 600/592
6,160,264 A * 12/2000 Rebiere ..... A43D 1/02 250/559.22
7,446,884 B2 * 11/2008 Massen ..... G01B 11/24 356/601
7,950,163 B2 * 5/2011 Lo ..... A61B 5/1036 33/515
8,192,375 B2 * 6/2012 Boneh ..... A61B 5/1036 600/592
8,290,739 B2 * 10/2012 Tadin ..... A61B 5/1036 600/595

(Continued)

FOREIGN PATENT DOCUMENTS

KR 10-2014-0123977 A 10/2014
KR 10-2017-0002037 A 1/2017
WO 2005-094623 A1 10/2005

OTHER PUBLICATIONS

International Search Report issued in corresponding International Patent Application No. PCT/KR2018/008757, dated Dec. 5, 2018.

*Primary Examiner* — George B Bennett
(74) *Attorney, Agent, or Firm* — McDermott Will & Emery LLP

(57) ABSTRACT

The present disclosure relates to an apparatus, for generating information about the interior of a shoe, comprising: a sensor unit into which material can be injected and which can sense physical changes on the surface; a material injection unit for injecting the material into the sensor unit; and a processor unit for generating information on the interior of the shoe on the basis of the physical change of the surface sensed by the sensor unit.

20 Claims, 6 Drawing Sheets

(56) References Cited

U.S. PATENT DOCUMENTS

| | | | | |
|---|---|---|---|---|
| 8,776,612 | B2 * | 7/2014 | Zampieri | A43D 1/08 73/849 |
| 9,841,331 | B2 | 12/2017 | Wood et al. | |
| 10,533,913 | B2 * | 1/2020 | Lee | B25J 13/085 |
| 10,782,124 | B2 * | 9/2020 | Chuyko | G01B 5/30 |
| 2004/0184040 | A1 * | 9/2004 | Fujita | A43D 1/06 356/602 |
| 2014/0276235 | A1 | 9/2014 | Raniere | |
| 2016/0219972 | A1 * | 8/2016 | Davies | A43B 7/24 |
| 2016/0367191 | A1 | 12/2016 | Esposito et al. | |
| 2021/0052033 | A1 * | 2/2021 | Bessho | B32B 3/18 |

* cited by examiner

[FIG.1]
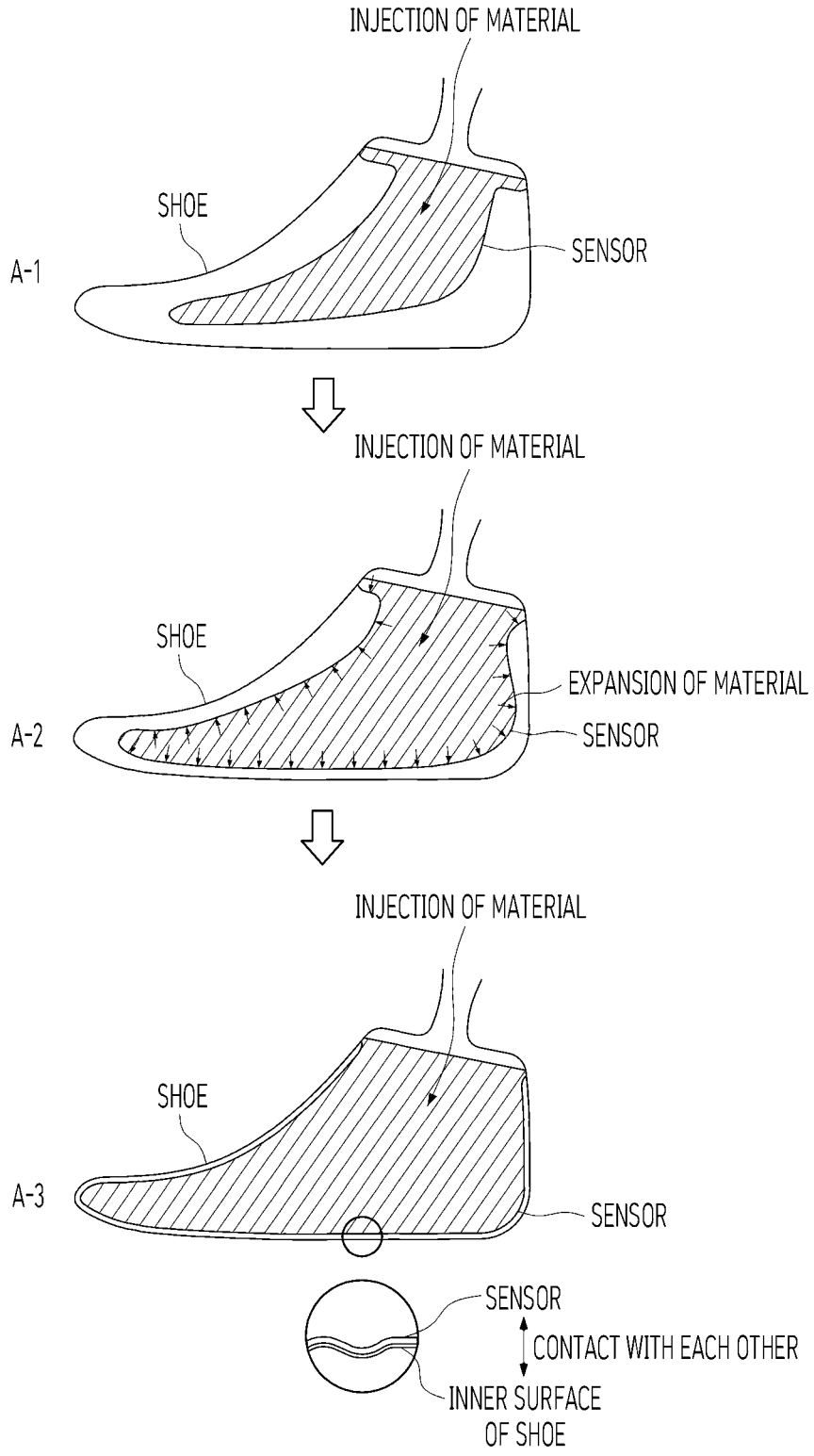

【FIG. 2】
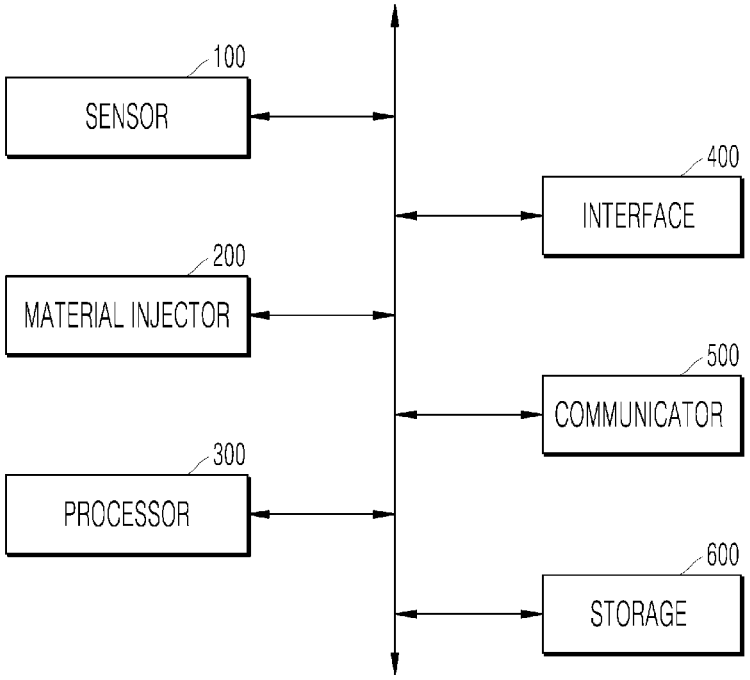
【FIG. 3】
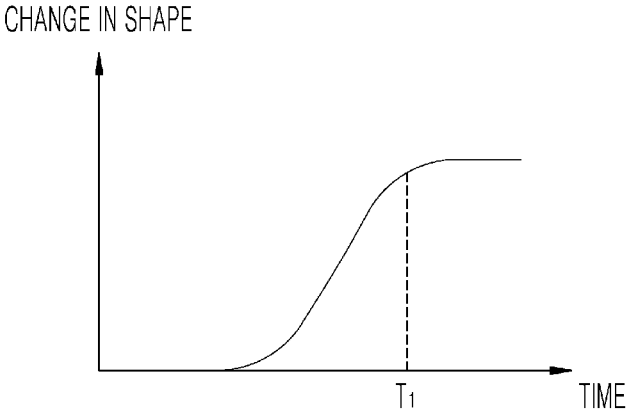

【FIG. 4】
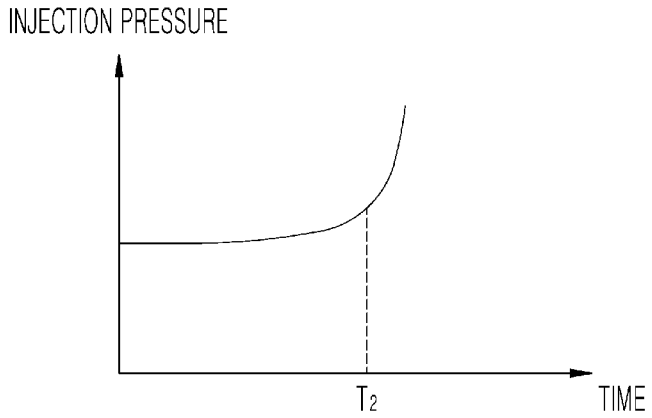
【FIG. 5】
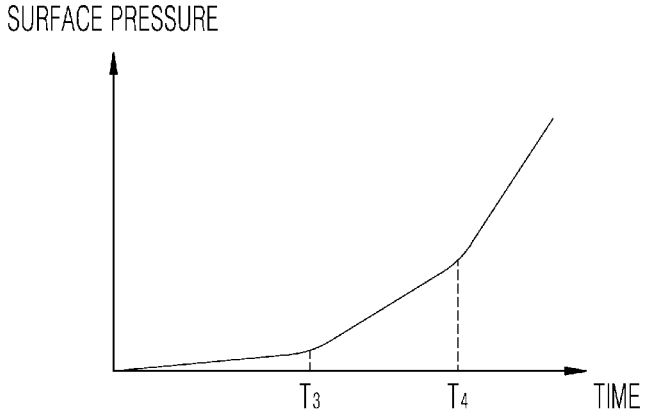

【FIG. 6】
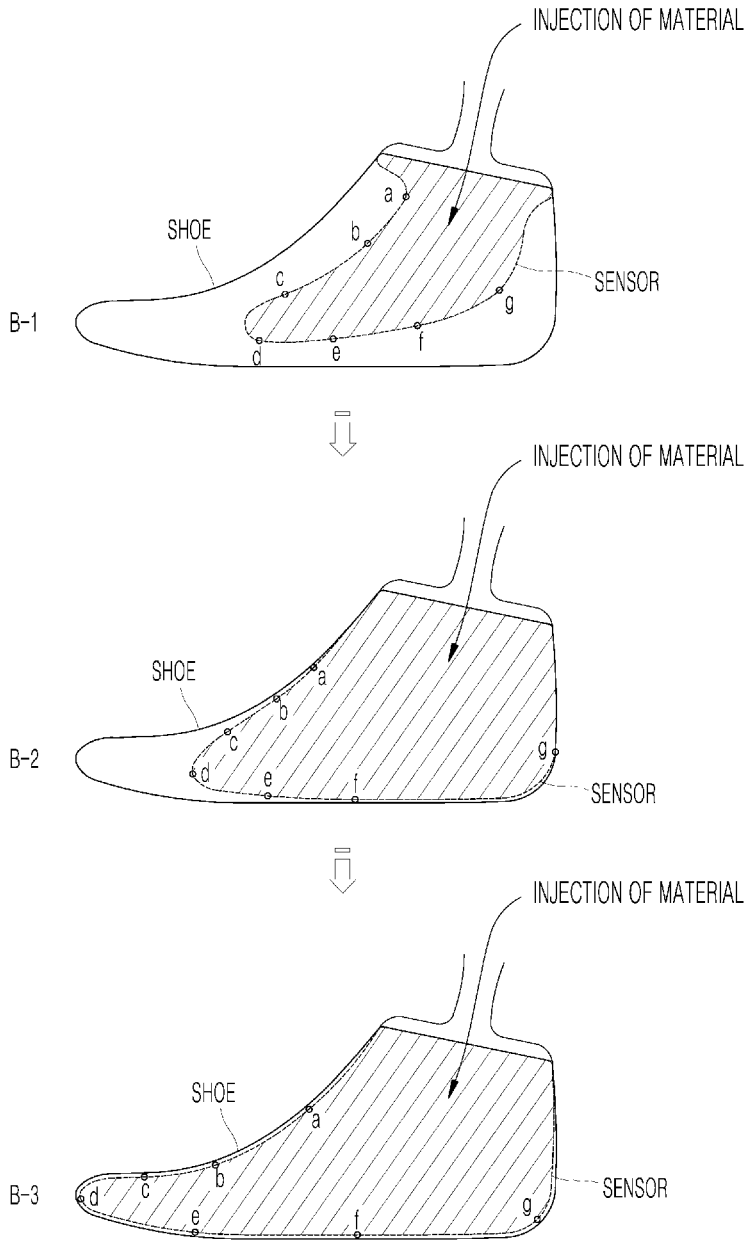

[FIG.7]
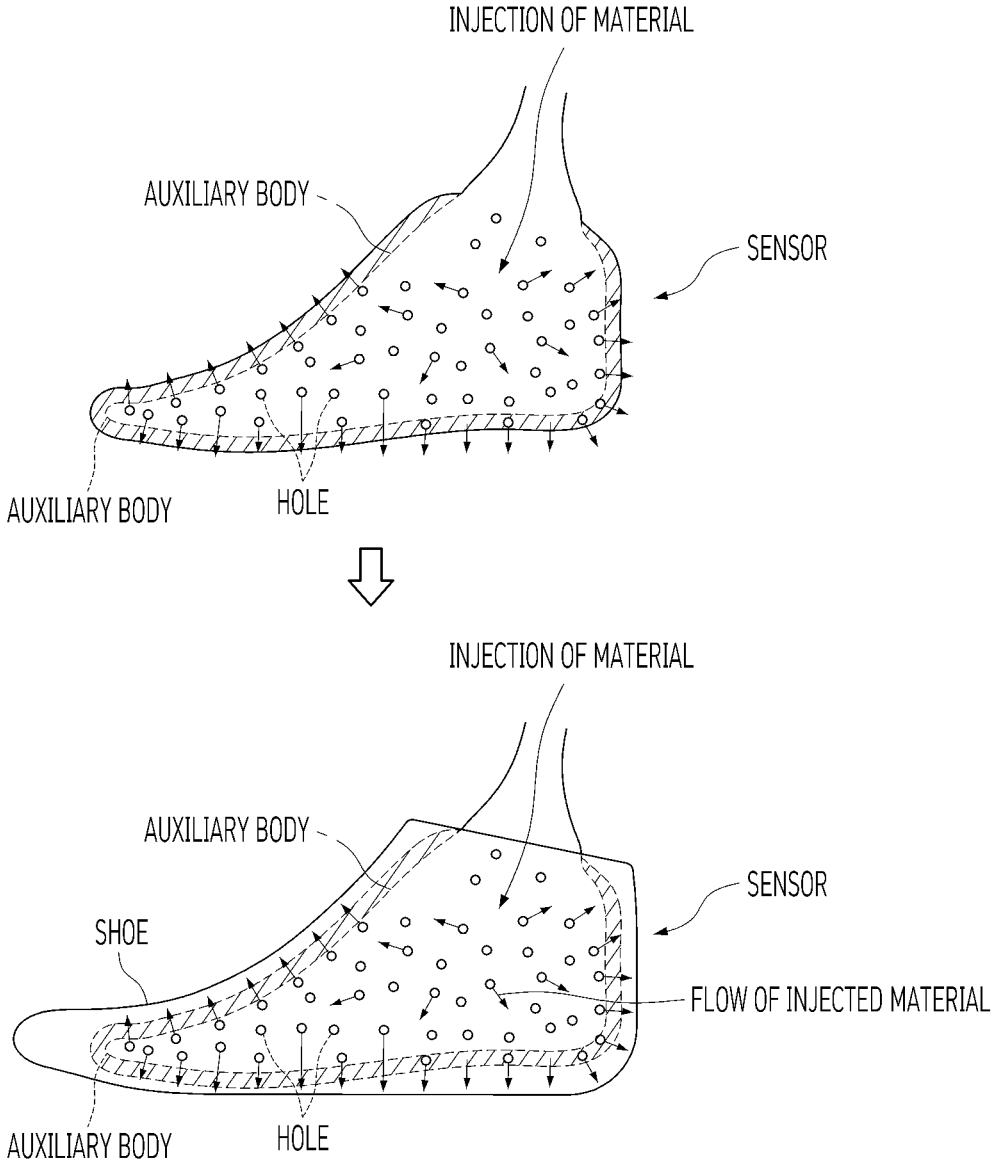

【FIG. 8】
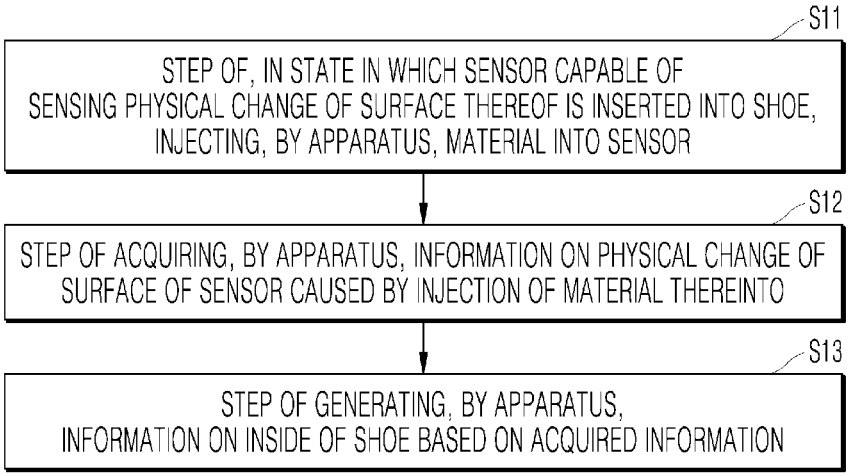

APPARATUS FOR GENERATING INFORMATION ON INSIDE OF SHOE AND METHOD USING SAME

RELATED APPLICATION

This application is a national phase of PCT/KR2018/008757 filed on Aug. 1, 2018, which claims priority from Korean Application No. 10-2018-0026324 which was filed on Mar. 6, 2018, the disclosures of which Applications are incorporated by reference herein.

TECHNICAL FIELD

The present disclosure relates to an apparatus for generating information about an interior of a shoe, and more particularly to an apparatus for generating information about the interior of a shoe using a sensor configured to receive a material injected therein and to sense a physical change of the surface thereof caused by injection of the material therein.

BACKGROUND

The interior of a shoe is the inner space or the inner surface of a shoe, which receives the human foot. It is technically meaningful to accurately measure the dimensions of the insides of shoes and to model and database the measurement results. In the case of shoes manufactured through a mass production method, and even for shoes manufactured at the same production facility, the insides of the shoes may be formed in respectively different shapes due to manufacturing tolerance or the like, and it is therefore required to generate accurate information on the insides of the individual shoes after the manufacture thereof. Also, in the case of shoes manufactured through a customized method, it is required to verify whether the shoes have been manufactured to meet ordered specifications, and it is therefore required to generate accurate information about the interior of the shoes after the manufacture thereof.

In addition, with the recent development of wearable device and sensor technology, information on various body shapes has been stored in databases, and services that provide customized products for individuals utilizing information on their bodies have proliferated. Also, in the case of the shoe industry, it is possible to implement a service of providing shoes customized for the sizes or shapes of feet of respective individuals. To this end, it is necessary to accurately generate information on the insides of shoes manufactured through a mass production method or a customizing method.

However, conventionally, there has been no technology capable of generating 'accurate' information about the interior of a shoe. Although there has been proposed technology of measuring the dimensions of the interior of a shoe by radiating a laser beam in various directions within the interior of the shoe, it is difficult to precisely control a laser beam, and measurement errors are very large, making it difficult to generate accurate information on the interior of the shoe.

Therefore, there is a need for technology capable of accurately measuring the dimensions of the insides of shoes and of modeling and storing the measurement results in a database.

The present disclosure has been invented based on the above technical background, and has been invented to satisfy the aforementioned technical needs and to provide additional technical elements that may not be easily invented by those skilled in the art to which the present disclosure pertains.

DISCLOSURE

Technical Problem

It is an object of the present disclosure to provide technology capable of accurately measuring the dimensions of the interior of a shoe and of generating information thereon.

However, the technical objects to be accomplished by the present disclosure are not limited to the above-mentioned technical object, and various other technical objects will be clearly understood by those skilled in the art from the following description.

Technical Solution

An apparatus for generating information about the interior of a shoe according to the present disclosure for accomplishing the above and other objects may include a sensor configured to receive a material injected therein and to sense a physical change of the surface thereof, a material injector configured to inject the material into the sensor, and a processor configured to generate information on the interior of the shoe based on a physical change of the surface sensed by the sensor.

In addition, in the 'apparatus for generating information about the interior of a shoe' according to the present disclosure, the sensor may sense a change in the shape of the surface, and the processor may determine a final data computation timing based on information on the change in the shape of the surface, and may generate information on the interior of the shoe after the final data computation timing.

In addition, in the apparatus for generating information about the interior of a shoe according to the present disclosure, the surface of the sensor may include a surface formed of a flexible material or a fiber material, the sensor may generate an electrical signal indicating the change in the shape of the surface, and the processor may determine the final data computation timing based on the electrical signal generated by the sensor.

In addition, in the apparatus for generating information about the interior of a shoe according to the present disclosure, the processor may observe a change rate over time with respect to the change in the shape of the surface, may determine whether the change rate is reduced below a specific reference value in the state in which the material injector injects a constant amount of material per unit time, and may generate information on the interior of the shoe after the change rate is reduced below the specific reference value.

In addition, in the apparatus for generating information about the interior of a shoe according to the present disclosure, the sensor may separately sense a plurality of individual rates of change in the shape of a plurality of points on the surface, and the processor may determine the final data computation timing based on the sensed plurality of individual rates of change in the shape.

In addition, in the apparatus for generating information about the interior of a shoe according to the present disclosure, the plurality of points may include a predetermined plurality of reference points, and the processor may determine whether the individual rates of change in the shape of the plurality of reference points are reduced below a specific reference value, and may determine the final data computation timing when all of the individual rates of change in the shape of the reference points are reduced below the specific reference value.

In addition, in the apparatus for generating information about the interior of a shoe according to the present disclosure, the material injector may sense an injection pressure of the material, and the processor may determine a final data computation timing based on information on the injection pressure of the material, and may generate information on the interior of the shoe after the final data computation timing.

In addition, in the apparatus for generating information about the interior of a shoe according to the present disclosure, the processor may determine whether an injection pressure required for continuous injection of the material exceeds a specific reference value, and may generate information on the interior of the shoe after the injection pressure exceeds the specific reference value.

In addition, in the apparatus for generating information about the interior of a shoe according to the present disclosure, the sensor may sense an amount of force applied to the surface, and the processor may determine a final data computation timing based on information on the amount of force applied to the surface, and may generate information on the interior of the shoe after the final data computation timing.

In addition, in the apparatus for generating information about the interior of a shoe according to the present disclosure, the surface of the sensor may include a surface formed of a flexible material or a fiber material, the sensor may generate an electrical signal indicating the amount of force applied to the surface, and the processor may determine the final data computation timing based on the electrical signal generated by the sensor.

In addition, in the apparatus for generating information about the interior of a shoe according to the present disclosure, the sensor may separately sense a plurality of individual amounts of force applied to a plurality of points on the surface, and the processor may determine the final data computation timing based on the sensed plurality of individual amounts of force.

In addition, in the apparatus for generating information about the interior of a shoe according to the present disclosure, the plurality of points may include a predetermined plurality of reference points, and the processor may determine whether the individual amounts of force respectively applied to the plurality of reference points exceed a specific reference value, and may determine the final data computation timing when all of the individual amounts of force respectively applied to the reference points exceed the specific reference value.

In addition, in the apparatus for generating information about the interior of a shoe according to the present disclosure, the sensor may sense a change in the shape of the surface and an amount of force applied to the surface, and the processor may determine a final data computation timing based both on information on the change in the shape of the surface and on information on the amount of force applied to the surface, and may generate information on the interior of the shoe after the final data computation timing.

In addition, the apparatus for generating information about the interior of a shoe according to the present disclosure may further include an auxiliary body configured to be inserted into the sensor, and the material injector may inject the material into the sensor through the auxiliary body.

In addition, in the apparatus for generating information about the interior of a shoe according to the present disclosure, the auxiliary body may include a plurality of holes formed in the surface thereof, and may distribute the material injected from the material injector into the sensor through the plurality of holes.

In addition, in the apparatus for generating information about the interior of a shoe according to the present disclosure, the auxiliary body may be formed in the shape of a shoe or a foot.

In addition, in the apparatus for generating information about the interior of a shoe according to the present disclosure, the material may be a material in a gel state.

Next, a method of generating information about the interior of a shoe according to the present disclosure for accomplishing the above and other objects may include: (a) in the state in which a sensor configured to sense a physical change of the surface thereof is inserted into the shoe, injecting, by an apparatus, a material into the sensor; (b) acquiring, by the apparatus, information on a physical change of the surface of the sensor caused by injection of the material; and (c) generating, by the apparatus, information on the interior of the shoe based on the acquired information.

In addition, in the method of generating information about the interior of a shoe according to the present disclosure, step (b) may include acquiring, by the apparatus, information on a change in the shape of the surface, information on force applied to the surface, or information on an injection pressure of the material, and determining, by the apparatus, a final data computation timing based on the information on the change in the shape of the surface, the information on the force applied to the surface, or the information on the injection pressure of the material.

In addition, the method of generating information about the interior of a shoe may be implemented through a program and then stored on a storage medium, or may be distributed through a program provision server.

Advantageous Effects

The present disclosure may provide technology capable of accurately measuring the dimensions of the insides of shoes and of modeling and storing in a database the measurement results. Specifically, the present disclosure is capable of accurately measuring the dimensions of the insides of shoes and of modeling and storing in a database the measurement results using a sensor configured to receive a material injected therein and to sense a physical change of the surface thereof caused by injection of the material therein.

In addition, the present disclosure may accurately determine a final data computation timing in the process of measuring the dimensions of the interior of a shoe through injection of a material therein. Specifically, the present disclosure may accurately determine a final data computation timing based on information on a change in the shape of the surface of a sensor, information on the injection pressure of the material, or information on the amount of force applied to the surface of the sensor, and may generate accurate information on the interior of the shoe based thereon.

In addition, the present disclosure may separately sense the individual amounts of force applied to a plurality of points on the surface of the sensor, and may determine a final data computation timing based thereon, thereby more accurately generating information on the interior of the shoe.

In addition, the present disclosure may reduce the amount of material that is injected in the process of measuring the dimensions of the interior of the shoe, and may enable uniform injection of the material into the sensor in multiple directions. Specifically, the present disclosure may reduce the amount of material that is injected into the sensor by injecting the material via an auxiliary body, which is formed in the shape of a foot or the like, and may enable uniform injection of the material into the sensor in multiple directions using a plurality of holes formed in the auxiliary body.

Meanwhile, the effects of the present disclosure are not limited to the above-mentioned effects, and various other effects will be clearly understood by those skilled in the art from the following description.

DESCRIPTION OF DRAWINGS

FIG. 1 is a view illustrating the operation of an apparatus for generating information about the interior of a shoe, according to an exemplary embodiment of the present disclosure.

FIG. 2 is a constitutional diagram illustrating the components of the apparatus for generating information about the interior of a shoe, according to an exemplary embodiment of the present disclosure.

FIG. 3 is a graph illustrating a rate of change in the shape of the surface of a sensor over time.

FIG. 4 is a graph illustrating an injection pressure of a material over time.

FIG. 5 is a graph illustrating a rate of change in the pressure of the surface of the sensor over time.

FIG. 6 is a view illustrating the operation of an apparatus for generating information about the interior of a shoe, according to another exemplary embodiment of the present disclosure.

FIG. 7 is a view illustrating the operation of an apparatus for generating information about the interior of a shoe, according to still another exemplary embodiment of the present disclosure.

FIG. 8 is a flowchart showing a method of measuring the dimensions of the interior of a shoe, according to the present disclosure.

In addition, the reference numerals used in the drawings will be described below.

100: sensor
200: material injector
300: processor
400: interface
500: communicator
600: storage

DETAILED DESCRIPTION

Hereinafter, an apparatus for generating information about the interior of a shoe and a method using the same according to the present disclosure will be described in detail with reference to the accompanying drawings. The embodiments to be described herein are provided in order for those skilled in the art to easily understand the technical spirit of the present disclosure, and the present disclosure is not limited to the embodiments. Furthermore, matters represented in the accompanying drawings have been diagrammed in order to easily describe the embodiments of the present disclosure, and the contents may be different from forms that are actually implemented.

Meanwhile, each of the components represented herein is only an example of an implementation of the present disclosure. Accordingly, in other embodiments of the present disclosure, different components may be used, without departing from the spirit and scope of the present disclosure. Further, each component may be purely formed of a hardware or software element, but may also be implemented using a combination of various hardware and software elements that perform the same function. Furthermore, two or more components may be realized by one hardware or software element.

Furthermore, an expression of 'including' or 'comprising' elements is an expression of an open type, which merely refers to the presence of corresponding elements, and should not be construed as precluding additional elements.

Hereinafter, an apparatus for generating information about the interior of a shoe according to the present disclosure will be generally described.

The present disclosure may generate information about the interior of a shoe using a sensor configured to receive a material injected therein and to sense a physical change of a surface thereof caused by injection of the material therein.

Specifically, according to the present disclosure: 1) a material is injected into the sensor in the state in which the sensor is inserted into a shoe, 2) the sensor is expanded or extended by injection of the material so that the surface of the sensor comes into contact with the inner surface of the shoe, and 3) a physical change of the surface of the sensor (e.g., a change in the shape thereof or a change in the force applied thereto) is sensed in this state (the state in which the shape of the surface of the sensor is substantially the same as the shape of the inner surface of the shoe), thereby enabling the generation of accurate information on the interior of the shoe.

Hereinafter, the apparatus for generating information about the interior of a shoe according to an exemplary embodiment of the present disclosure will be described with reference to FIGS. 1 to 5.

As can be seen from FIG. 1, the apparatus for generating information about the interior of a shoe according to an exemplary embodiment of the present disclosure is capable of generating information about the interior of a shoe using a sensor configured to receive a material injected therein and to sense a physical change thereof caused by injection of the material therein.

The operations illustrated in FIG. 1 will be described below.

1) A-1 of FIG. 1: shows that a sensor included in the apparatus according to an exemplary embodiment of the present disclosure is inserted into a shoe and a material is injected into the sensor.

2) A-2 of FIG. 1: shows that, as the amount of material that is injected into the sensor increases, the surface of the sensor (which may be formed of a flexible material, a fiber material, or the like) expands.

3) A-3 of FIG. 1: shows that, as the amount of material that is injected into the sensor further increases, the surface of the sensor further expands, and finally, the surface of the sensor comes into contact with the inner surface of the shoe. In this case, since the shape of the surface of the sensor can be regarded as being substantially the same as the shape of the inner surface of the shoe, information on the inner surface of the shoe may be generated by sensing the physical properties (the volume, the surface area, the three-dimensional shape, etc.) of the surface of the sensor.

As can be seen from FIG. 2, the apparatus for generating information about the interior of a shoe according to an exemplary embodiment of the present disclosure may include a sensor 100, a material injector 200, a processor 300, an interface 400, a communicator 500, and a storage 600, and may further include, in addition to these components, various components for implementing various operations described in this specification.

The sensor 100 may be configured to be inserted into a shoe in order to generate information on the interior of the shoe. The sensor 100 may receive a material injected therein, may sense a physical change of the surface thereof caused by injection of the material therein, and may generate information on the interior of the shoe based on this operation.

In addition, the sensor 100 may be formed in a shape having an internal receiving space capable of receiving a material. For example, the sensor 100 may be formed in a sock shape, a pocket shape, a pouch shape, or the like, so as to receive the material. In addition, the material that is capable of being received in the sensor 100 may be any of various types of materials in a solid, liquid, or gaseous state. However, it is preferable for the material to be a material in a gel state. When the material is a material in a gel state, the surface of the sensor 100 may be brought into closer contact with the inner surface of the shoe.

Further, the sensor 100 may be formed of a material capable of expanding (increasing in volume) or extending (increasing in surface area) upon receiving the material injected therein. For example, the sensor 100 may be formed of a flexible material, a fiber material, or the like.

Furthermore, the sensor 100 may sense a change in the shape (form) of the surface thereof, and may generate an electrical signal indicating the change in the shape of the surface thereof. For example, the sensor 100 may sense a change in volume defined by the surface thereof (a change in the volume of the internal space in which the material is received), a change in the surface area of the surface thereof, and a change in the three-dimensional shape of the surface thereof, and may generate electrical signals indicating these physical properties.

Furthermore, the sensor 100 may sense a force applied to the surface thereof, and may generate an electrical signal indicating the sensed force. For example, the sensor 100 may sense a change in the physical force applied to the surface thereof, and may generate an electrical signal indicating this physical property. In this case, the sensor 100 may sense the average of the amounts of force applied to the entirety of the surface thereof, or may sense the individual amounts of force respectively applied to different portions of the surface thereof.

Meanwhile, the sensor 100 may sense a change in the shape of the surface thereof or a change in the force applied thereto by sensing a change in the resistance or in the capacitance of the surface thereof, and may be configured as any of various types of sensors, such as a fiber sensor, a flexible sensor, or a stretch sensor.

The material injector 200 may be configured to inject the material into the sensor.

The material injector 200 may be connected to the sensor 100 via a connection element such as a pipe, and may inject the material into the sensor 100 through this connection.

Further, the material injector 200 may inject any of various types of materials in a solid, liquid, or gaseous state, and may preferably inject a material in a gel state.

Furthermore, the material injector 200 may adjust the amount of material that is injected, and may measure and adjust the pressure at which the material is injected. For example, the material injector 200 may include an injection pump and an injection pressure sensor. The material injector 200 may adjust the amount of material that is injected using the injection pump, and may measure and adjust the pressure at which the material is injected using the injection pressure sensor.

The processor 300 may be configured to be connected to the components of the apparatus for generating information about the interior of a shoe to control the components and to perform various calculation processes. Specifically, the processor 300 may be connected to the sensor 100, the material injector 200, the interface 400, the communicator 500, and the storage 600 to exchange electrical signals therewith, to control the operation thereof, and to perform various calculation processes for generating information about the interior of a shoe.

The processor 300 may be embodied as any of various operational units such as a universal central processing unit (CPU), a programmable device element (CPLD, FPGA) configured to be suitable for a specific purpose, an on-demand application-specific integrated circuit (ASIC), and a microcontroller chip.

In particular, the processor 300 may generate information on the interior of the shoe based on the physical change of the surface of the sensor 100 sensed by the sensor 100. Specifically, the processor 300 may acquire information on the physical change of the surface of the sensor 100 based on the electrical signal received from the sensor 100, may determine a final data computation timing based on the information on the physical change of the surface of the sensor 100, and may generate information on the interior of the shoe after the final data computation timing. Here, the 'final data computation timing' is a timing at which the surface of the sensor 100 comes into close contact with the inner surface of the shoe, and thus the shape of the surface of the sensor 100 is substantially the same as the shape of the inner surface of the shoe. After the final data computation timing, the physical properties (the volume, the surface area, the three-dimensional shape, etc.) of the surface of the sensor 100 can be considered substantially the same as the physical properties of the inner surface of the shoe, and thus the processor 300 may generate accurate information on the interior of the shoe based on the information generated by the sensor 100.

For example, the processor 300 may determine the final data computation timing based on the information on the change in the shape of the surface of the sensor 100, and may generate information on the interior of the shoe after the determined timing. In this case, the processor 300 may observe a change rate over time with respect to the change in the shape of the surface of the sensor 100, may perform control such that the material injector 200 injects a constant amount of material per unit time, may determine whether the surface shape change rate is reduced below a specific reference value in the state in which a constant amount of material per unit time is injected into the sensor 100, and may determine that the final data computation timing has come when the surface shape change rate is reduced below the specific reference value. When the surface of the sensor 100 comes into contact with the inner surface of the shoe, expansion or extension of the surface of the sensor 100 is suppressed, and the rate of change in the shape thereof is greatly reduced. Thus, it is possible to determine whether the 'final data computation timing' has come by monitoring the shape change rate. FIG. 3 illustrates an exemplary change in the shape of the surface of the sensor 100 in the state in which a constant amount of material is injected into the sensor 100 per unit time. As illustrated in FIG. 3, the processor 300 may recognize a timing T1 at which the rate of change in the shape of the surface of the sensor 100 (the slope at which the surface changes) is reduced below the specific reference value, and may determine the recognized timing T1 as the final data computation timing.

In addition, the processor 300 may determine the final data computation timing based on the information on the material injection pressure, and may generate information on the interior of the shoe after the determined timing. In this case, the processor 300 may acquire information on the material injection pressure from the material injector 200, may determine whether the injection pressure required for continuous injection of the material exceeds a specific reference value, and may determine that the final data computation timing has come when the injection pressure exceeds the specific reference value. When the surface of the sensor 100 comes into contact with the inner surface of the shoe, the injection pressure required to continuously inject the material into the sensor 100 is greatly increased. Thus, it is possible to determine whether the final data computation timing has come by monitoring the increase in the injection pressure. FIG. 4 illustrates an exemplary change in the injection pressure required to continuously inject the material into the sensor 100. As illustrated in FIG. 4, the processor 300 may recognize a timing T2 at which the injection pressure exceeds the specific reference value, and may determine the recognized timing T2 as the final data computation timing.

In addition, the processor 300 may determine the final data computation timing based on the information on the change in the force applied to the surface (the surface pressure change) of the sensor 100, and may generate information on the interior of the shoe after the determined timing. In this case, the processor 300 may observe a change rate over time with respect to the change in the force applied to the surface of the sensor 100, may determine whether the rate of change in the force applied to the surface of the sensor 100 exceeds a specific reference value, and may determine that the final data computation timing has come when the force change rate exceeds the specific reference value. When the surface of the sensor 100 comes into contact with the inner surface of the shoe, the amount of force applied to the surface of the sensor 100 is greatly increased. Thus, it is possible to determine whether the final data computation timing has come by monitoring the force change rate. FIG. 5 illustrates an exemplary change in the force applied to the surface of the sensor 100. As illustrated in FIG. 5, the processor 300 may recognize a timing T3 at which the rate of change in the force applied to the surface of the sensor 100 (the slope at which the force changes) exceeds the specific reference value (the first reference value), and may determine a certain timing after the recognized timing T3 as the final data computation timing. In addition, the processor 300 may further recognize a timing T4 at which the rate of change in the force applied to the surface of the sensor 100 exceeds a second reference value, and may determine a certain timing between the timing T3 recognized previously and the timing T4 as the final data computation timing. In most cases, since the inner surface of the shoe is formed of a shock-absorbing material or an elastic material, even after the sensor 100 comes into contact with the inner surface of the shoe, the rate of increase in the force applied to the surface of the sensor 100 may be suppressed to a certain limit (a shock-absorbing limit or an elastic limit). In the case in which the timing T4 is determined, the material of the inner surface of the shoe may also be taken into consideration as a factor for determination. For example, the processor 300 may select: 1) a timing closer to the timing T3 than to the timing T4 and located therebetween as the final data computation timing to generate information on the interior of the shoe that is capable of providing a loose fit; 2) a timing closer to the timing T4 than to the timing T3 and located therebetween as the final data computation timing to generate information on the interior of the shoe that is capable of providing a tight fit; or 3) a substantially intermediate timing between the timing T3 and the timing T4 as the final data computation timing to generate information on the interior of the shoe that is capable of providing an intermediate fit.

In addition, the processor 300 may determine the final data computation timing based on at least two of the information on the change in the shape of the surface of the sensor 100, the information on the injection pressure of the material, and the information on the change in the force applied to the surface of the sensor 100. For example, the processor 300 may determine the final data computation timing based on: 1) both the information on the change in the shape of the surface and the information on the change in the force applied to the surface; 2) both the information on the change in the shape of the surface and the information on the injection pressure of the material; 3) both the information on the injection pressure of the material and the information on the force applied to the surface; or 4) all of the information on the change in the shape of the surface, the information on the injection pressure of the material, and the information on the change in the force applied to the surface, thereby further improving the accuracy of the final data computation timing.

The interface 400 may be configured to input or output various pieces of information, and may include an input module for receiving information from a user and an output module for providing information to a user.

This interface 400 may perform an operation of receiving or outputting various pieces of information related to generation of information on the interior of the shoe.

The communicator 500 may be configured to connect the apparatus for generating information about the interior of a shoe to various devices in a wired or wireless manner. Using this communicator 500, the apparatus for generating information about the interior of a shoe may exchange information with various devices, or may operate in a manner interlocked with the operation of various devices.

In addition, the communicator 500 may include various wired communication modules or wireless communication modules. For example, the communicator 500 may include various wired communication modules or wireless communication modules defined by organizations such as ITU, ISO, IEC, 3GPP, IEEE, ETSI, IETF, EIA, and FTSC.

The storage 600 may be configured to store various pieces of information related to an operation for generating information about the interior of a shoe. For example, the storage 600 may be configured to store various pieces of information including information related to the operation of the sensor 100, information related to the operation of the material injector 200, information related to the operation of the processor 300, information related to the operation of the interface 400, and information related to the operation of the communicator 500.

This storage 600 may be implemented using various devices, including various types of memory devices.

Hereinafter, an 'apparatus for generating information about the interior of a shoe' according to another exemplary embodiment of the present disclosure will be described with reference to FIG. 6.

The apparatus for generating information about the interior of a shoe according to another exemplary embodiment of the present disclosure may separately sense a plurality of individual physical changes that occur at a plurality of points on the surface of the sensor, thereby more accurately determining the final data computation timing based on the above operation.

First, the apparatus for generating information about the interior of a shoe according to another exemplary embodiment of the present disclosure may separately sense a plurality of individual amounts of force applied to a plurality of points on the surface of the sensor, thereby more accurately determining the final data computation timing based on the above operation.

Specifically, according to another exemplary embodiment of the present disclosure, a plurality of reference points may be set by the sensor or the processor included in the apparatus, the sensor may separately sense a plurality of individual amounts of force applied to the plurality of reference points, and the processor may determine whether the individual amounts of force respectively applied to the plurality of reference points exceed a specific reference value (e.g., an upper-limit reference value with respect to the force), and may determine that the final data computation timing has come when all of the individual amounts of force respectively applied to the plurality of reference points exceed the specific reference value.

For example, the apparatus according to another exemplary embodiment of the present disclosure, as shown in FIG. 6, may set a plurality of reference points a, b, c, d, e, f, and g, which are evenly distributed over the entirety of the surface of the sensor, may determine whether the individual amounts of force respectively applied to the plurality of reference points a, b, c, d, e, f, and g exceed a specific reference value, and may determine that the final data computation timing has come when all of the individual amounts of force respectively applied to the plurality of reference points a, b, c, d, e, f, and g exceed the specific reference value. Accordingly, through the above operation, it is possible to compute the final data in the state in which all of the reference points are in tight contact with the inner surface of a shoe and to generate information on the interior of the shoe in the state in which the identity between the shape of the surface of the sensor and the shape of the inner surface of the shoe is more reliably secured.

Described in more detail with reference to FIG. 6, the apparatus may perform operations of: 1) setting a plurality of reference points a, b, c, d, e, f, and g that are evenly distributed over the entirety of the surface of the sensor, as shown in B-1 of FIG. 6; 2) determining that the final data computation timing has not come when the individual amounts of force respectively applied to some points a, b, f, and g of the plurality of reference points are greater than or equal to the specific reference value but the individual amounts of force respectively applied to the remaining reference points c, d, and e are less than the specific reference value, as shown in B-2 of FIG. 6; and 3) may determine that all of the reference points a, b, c, d, e, f, and g are in contact with the inner surface of the shoe and that the final data computation timing has come when the individual amounts of force respectively applied to the remaining reference points c, d, and e also become greater than or equal to the specific reference value, as shown in B-3 of FIG. 6.

Next, the apparatus for generating information about the interior of a shoe according to another exemplary embodiment of the present disclosure may separately sense a plurality of individual rates of change in the shape of the plurality of points on the surface of the sensor (e.g., a rate of change in the shape of the surface over time), thereby more accurately determining the 'final data computation timing' based on the above operation.

Specifically, according to another exemplary embodiment of the present disclosure, a plurality of reference points may be set by the sensor or the processor included in the apparatus, the sensor may separately sense a plurality of individual rates of change in the shape of the plurality of reference points, and the processor may determine whether the individual rates of change in the shape of the plurality of reference points are reduced below a specific reference value (e.g., a lower-limit reference value with respect to the shape change rate), and may determine that the final data computation timing has come when all of the individual rates of change in the shape of the reference points are reduced below the specific reference value.

For example, the apparatus according to another exemplary embodiment of the present disclosure, as shown in FIG. 6, may set a plurality of reference points a, b, c, d, e, f, and g, which are evenly distributed over the entirety of the surface of the sensor, may determine whether the individual rates of change in the shape of the plurality of reference points a, b, c, d, e, f, and g are reduced below a specific reference value, and may determine that the final data computation timing has come when all of the individual rates of change in the shape of the plurality of reference points a, b, c, d, e, f, and g are reduced below the specific reference value. Accordingly, through the above operation, it is possible to compute the final data in the state in which all of the reference points are in tight contact with the inner surface of a shoe and to generate information on the interior of the shoe in the state in which the identity between the shape of the surface of the sensor and the shape of the inner surface of the shoe is more reliably secured.

Described in more detail with reference to FIG. 6, the apparatus may perform operations of: 1) setting a plurality of reference points a, b, c, d, e, f, and g that are evenly distributed over the entirety of the surface of the sensor, as shown in B-1 of FIG. 6; 2) determining that the final data computation timing has not come when the rates of change in the shape of some a, b, f, and g of the plurality of reference points are less than or equal to the specific reference value but the rates of change in the shape of the remaining reference points c, d, and e are greater than the specific reference value, as shown in B-2 of FIG. 6; and 3) may determine that all of the reference points a, b, c, d, e, f, and g are in contact with the inner surface of the shoe and that the final data computation timing has come when the rates of change in the shape of the remaining reference points c, d, and e also become less than or equal to the specific reference value, as shown in B-3 of FIG. 6.

Hereinafter, an 'apparatus for generating information about the interior of a shoe' according to still another exemplary embodiment of the present disclosure will be described with reference to FIG. 7.

The apparatus for generating information about the interior of a shoe according to still another exemplary embodiment of the present disclosure may further include an auxiliary body that is capable of being inserted into the sensor, and the material injector may be configured to inject a material into the sensor through the auxiliary body. Utilizing this auxiliary body, the apparatus may reduce the amount of material to be injected into the sensor (because the auxiliary body occupies a predetermined amount of space in the sensor), may support the sensor, may enable the sensor to be easily inserted into the shoe, and may enable more uniform injection of the material into the sensor.

Here, the auxiliary body may be preferably formed in the shape of a shoe or a foot, as shown in FIG. 7. Due to this shape of the auxiliary body, the sensor may be easily supported and inserted into the shoe, and may perform measurement in the state of occupying a sufficient amount of space in the shoe.

In addition, the auxiliary body may include a plurality of holes formed in the surface thereof, as shown in FIG. 7, so that the material injected from the material injector is distributed into the sensor through the plurality of holes. Due to this shape and operation thereof, the auxiliary body may enable more uniform injection of the material into the sensor, and may enable uniform expansion or extension of the surface of the sensor in multiple directions.

Hereinafter, a method of generating information about the interior of a shoe according to the present disclosure will be described with reference to FIG. 8.

The method of generating information about the interior of a shoe according to the present disclosure to be described below may include substantially the same technical characteristics as the apparatus for generating information about the interior of a shoe described above, although they belong to different categories.

Accordingly, although not described in detail in order to avoid redundancy, the characteristics described above in relation to the apparatus for generating information about the interior of a shoe may also be deduced and applied to the method of generating information about the interior of a shoe according to the present disclosure.

Referring to FIG. 8, the method of generating information about the interior of a shoe according to the present disclosure may include a step S11 of, in the state in which a sensor capable of sensing a physical change of the surface thereof is inserted into a shoe, injecting, by an apparatus, a material into the sensor.

Subsequently, the method of generating information about the interior of a shoe according to the present disclosure may include, after the step S11, a step S12 of acquiring, by the apparatus, information on a physical change of the surface of the sensor caused by injection of the material therein.

Here, the step S12 may further include a step of acquiring, by the apparatus, information on a change in the shape of the surface, information on force applied to the surface, or information on the injection pressure of the material. In addition, the step S12 may further include a step of determining, by the apparatus, a final data computation timing based on the information on the change in the shape of the surface, the information on the force applied to the surface, or the information on the injection pressure of the material.

Subsequently, the method of generating information about the interior of a shoe according to the present disclosure may include, after the step S12, a step S13 of generating, by the apparatus, information on the interior of the shoe based on the acquired information.

In addition, the method of generating information about the interior of a shoe described above may be implemented through a program and then stored in a storage medium, or may be distributed through a program provision server.

Here, the program shall be construed broadly to mean any type of instructions, whether referred to as software, application, firmware, middleware, microcode, hardware description language, or otherwise. In addition, instructions may include code (e.g., in source code format, binary code format, executable code format, or any other suitable format of code).

In addition, the storage medium may be any available medium that can be accessed by a general-purpose or special-purpose computer. By way of example, and not limitation, computer-readable media may include RAM, ROM, EEPROM, CD-ROM or other optical disk storage, magnetic disk storage or other magnetic storage devices, or any other medium that can be used to store or carry desired program code means in the form of instructions or data structures and that can be accessed by a general-purpose or special-purpose computer or a general-purpose or special-purpose processor.

The exemplary embodiments of the present disclosure described above have been disclosed for illustrative purposes, and the present disclosure is not limited to these embodiments. Further, those skilled in the art will appreciate that various modifications and changes are possible without departing from the spirit and scope of the invention, and that such modifications and changes are to be appreciated as being included in the scope of the invention.

The invention claimed is:

1. An apparatus for generating information about an interior of a shoe, the apparatus comprising:

a sensor configured to receive a material injected therein and to sense a physical change of a surface thereof;

a material injector configured to inject the material into the sensor; and a processor configured to generate information on the interior of the shoe based on a physical change of the surface sensed by the sensor.

2. The apparatus according to claim 1, wherein the sensor is further configured to sense a change in shape of the surface, and wherein the processor is further configured to:

determine a final data computation timing based on information on the change in shape of the surface, and generate information on the interior of the shoe after the final data computation timing.

3. The apparatus according to claim 2, wherein the surface of the sensor comprises a surface formed of a flexible material or a fiber material, wherein the sensor is further configured to generate an electrical signal indicating the change in shape of the surface, and wherein the processor is further configured to determine the final data computation timing based on the electrical signal generated by the sensor.

4. The apparatus according to claim 2, wherein the processor is further configured to:

observe a change rate over time with respect to the change in shape of the surface, determine whether the change rate is reduced below a specific reference value in a state in which the material injector injects a constant amount of material per unit time, and generate information on the interior of the shoe after the change rate is reduced below the specific reference value.

5. The apparatus according to claim 2, wherein the sensor is further configured to separately sense a plurality of individual rates of change in shape of a plurality of points on the surface, and wherein the processor is further configured to determine the final data computation timing based on the sensed plurality of individual rates of change in shape.

6. The apparatus according to claim 5, wherein the plurality of points comprise a predetermined plurality of reference points, and wherein the processor is further configured to:

determine whether the individual rates of change in shape of the plurality of reference points are reduced below a specific reference value, and determine the final data computation timing when all of the individual rates of change in shape of the reference points are reduced below the specific reference value.

7. The apparatus according to claim 1, wherein the material injector is further configured to sense an injection pressure of the material, and wherein the processor is further configured to:

determine a final data computation timing based on information on the injection pressure of the material, and generate information on the interior of the shoe after the final data computation timing.

8. The apparatus according to claim 7, wherein the processor is further configured to:

determine whether an injection pressure required for continuous injection of the material exceeds a specific reference value, and generate information on the interior of the shoe after the injection pressure exceeds the specific reference value.

9. The apparatus according to claim 1, wherein the sensor is further configured to sense an amount of force applied to the surface, and wherein the processor is further configured to:

determine a final data computation timing based on information on the amount of force applied to the surface, and generate information on the interior of the shoe after the final data computation timing.

10. The apparatus according to claim 9, wherein the surface of the sensor comprises a surface formed of a flexible material or a fiber material, wherein the sensor is further configured to generate an electrical signal indicating the amount of force applied to the surface, and wherein the processor is further configured to determine the final data computation timing based on the electrical signal generated by the sensor.

11. The apparatus according to claim 9, wherein the sensor is further configured to separately sense a plurality of individual amounts of force applied to a plurality of points on the surface, and wherein the processor is further configured to determine the final data computation timing based on the sensed plurality of individual amounts of force.

12. The apparatus according to claim 11, wherein the plurality of points comprises a predetermined plurality of reference points, and wherein the processor is further configured to:

determine whether the individual amounts of force respectively applied to the plurality of reference points exceed a specific reference value, and determine the final data computation timing when all of the individual amounts of force respectively applied to the reference points exceed the specific reference value.

13. The apparatus according to claim 1, wherein the sensor is further configured to sense a change in shape of the surface and an amount of force applied to the surface, and wherein the processor is further configured to:

determine a final data computation timing based both on information on the change in shape of the surface and on information on the amount of force applied to the surface, and generate information on the interior of the shoe after the final data computation timing.

14. The apparatus according to claim 1, further comprising:

an auxiliary body configured to be inserted into the sensor, wherein the material injector is further configured to inject the material into the sensor through the auxiliary body.

15. The apparatus according to claim 14, wherein the auxiliary body comprises a plurality of holes formed in a surface thereof, and is further configured to distribute the material injected from the material injector into the sensor through the plurality of holes.

16. The apparatus according to claim 14, wherein the auxiliary body is formed in a shape of a shoe or a foot.

17. The apparatus according to claim 1, wherein the material is a material in a gel state.

18. A method of generating information about an interior of a shoe, the method comprising:

(a) in a state in which a sensor configured to sense a physical change of a surface thereof is inserted into the shoe, injecting, by an apparatus, a material into the sensor;

(b) acquiring, by the apparatus, information on a physical change of the surface of the sensor caused by injection of the material; and (c) generating, by the apparatus, information on the interior of the shoe based on the acquired information.

19. The method according to claim 18, wherein step (b) comprises:

acquiring, by the apparatus, information on a change in shape of the surface, information on force applied to the surface, or information on an injection pressure of the material; and determining, by the apparatus, a final data computation timing based on the information on the change in shape of the surface, the information on the force applied to the surface, or the information on the injection pressure of the material.

20. A program stored on a storage medium, the program for executing a method of generating information about an interior of a shoe, the method comprising:

in a state in which a sensor configured to sense a physical change of a surface thereof is inserted into the shoe, injecting, by an apparatus, a material into the sensor;

acquiring, by the apparatus, information on a physical change of the surface of the sensor caused by injection of the material; and generating, by the apparatus, information on the interior of the shoe based on the acquired information.

* * * * *